US006893321B1

(12) United States Patent
Buchanan et al.

(10) Patent No.: US 6,893,321 B1
(45) Date of Patent: May 17, 2005

(54) MODULAR FLUID-DISPENSING SYSTEM

(75) Inventors: Arnold Buchanan, Deerfield, IL (US); Doug Ceckowski, Gurnee, IL (US); Deborah Doan, Ringwood, IL (US); Nicolas John Dougill, Coventry (GB); Michael F. Hart, Mundelein, IL (US); Scott Holt, Duesseldorf (DE); Kelly Leithner, Gurnee, IL (US); Chuck Shewey, Salem, WI (US)

(73) Assignee: Buehler Ltd., Lake Bluff, IL (US)

( * ) Notice: Subject to any disclaimer, the term of this patent is extended or adjusted under 35 U.S.C. 154(b) by 0 days.

(21) Appl. No.: 10/282,823

(22) Filed: Oct. 29, 2002

Related U.S. Application Data

(60) Provisional application No. 60/335,325, filed on Nov. 2, 2001.

(51) Int. Cl.[7] ..... B24B 49/00
(52) U.S. Cl. ..... 451/5; 451/41; 451/285
(58) Field of Search ..... 451/5, 41, 36, 451/60, 285, 286, 287, 446

(56) References Cited

U.S. PATENT DOCUMENTS

| | | | | |
|---|---|---|---|---|
| 4,513,894 A | | 4/1985 | Doyle et al. | |
| 4,678,119 A | | 7/1987 | Doyle | |
| 4,992,948 A | | 2/1991 | Pilland et al. | |
| 5,709,593 A | | 1/1998 | Guthrie et al. | |
| 5,843,269 A | | 12/1998 | Aaron et al. | |
| 5,857,893 A | * | 1/1999 | Olsen et al. | 451/5 |
| 5,957,759 A | * | 9/1999 | Cardenas et al. | 451/60 |
| 5,964,413 A | | 10/1999 | Mok | |
| 6,051,499 A | | 4/2000 | Tolles et al. | |

FOREIGN PATENT DOCUMENTS

| | | |
|---|---|---|
| EP | 0275826 A1 | 7/1988 |
| EP | 0990966 A2 | 4/2000 |
| WO | WO 02/39089 | 5/2002 |

OTHER PUBLICATIONS

Buehler™ METLAP 2000 Fluid Despenser, pp. 1-2.
Buehler™ METLAP1 Programmable Fluid Dispensing System, pp. 1-4.
Struers Mutidoser Instruction Manual, Jan. 25, 2000, pp. 1-35.
Struers Rotosystem, pp. 1-8.
Buehler™ Alpha, Beta & Vector Grinder Polishers and Power Head, pp. 1-4.

* cited by examiner

*Primary Examiner*—Joseph J. Hail, III
*Assistant Examiner*—Alvin J Grant
(74) *Attorney, Agent, or Firm*—Banner & Witcoff, Ltd.

(57) ABSTRACT

A modular fluid-dispensing system includes a master control dispenser and/or one or more satellite dispensers that communicate bi-directionally with the master control dispenser. The master control dispenser is programmable and may dispense one or more solutions. Each satellite may dispense fluid in either a stand-alone mode or under control of another fluid-dispensing-system component, such as a master control dispenser, or a grinder/polisher. A master control dispenser may store various multi-step dispensing methods and may advance a dispensing method to a next step automatically or based on a control signal received from a grinder/polisher. A master control dispenser may perform a fluid-dispensing method that is synchronized with a corresponding grinder/polisher method performed by a grinder/polisher that is coupled to the master control dispenser.

41 Claims, 18 Drawing Sheets

| Grinder/Polisher | First Satellite | Second Satellite |
|---|---|---|
| Master Power On/Off switch. Grinder gets power from wall outlet. | Power On/Off. Power supplied via 12V RJ45 plug and cable cord from grinder/polisher. Alternative scenario: power supplied from 12V DC transformer | Power On/Off. Power supplied via 12V RJ45 plug and cable cord |
| | Pump on & forward via touch panel | Pump on & forward via touch panel |
| | Pump on & backward via touch panel control | Pump on & backward via touch panel control |
| | Time and relative amount dispensed | Time and relative amount dispensed |
| Cycle start/stop via software | Turns first satellite's pump on to start cycle. Time and volume for first satellite can differ from second satellite. Start, though, is synchronized with on/off from the grinder/polisher. | Turns second satellite's pump on to start cycle. Time and volume for second satellite can differ from first satellite. Start, though is synchronized with on/off from the grinder/polisher. |

Figure 7

| Master Control Dispenser ("MCD") | | Satellite(s) |
|---|---|---|
| Power On/Off by operator using switch. Power supplied by wall outlet. | → | Power On/Off. Power supplied via 12V RJ45 plug and cable cord |
| Cycle On/Off | → | Turns one or more operator-selected Satellite pumps on at one time to start cycle. Time and volume may vary among the satellites. Start may be synchronized with on/off from MCD |
| First Bottle to be dispensed (bottle number) After selected, MCD searches to see if this bottle number is present within the system. If the bottle is not present, the MCD may display an error message to the operator. If another Satellite is plugged into system, the MCD detects new Satellite and displays a message to operator to set the bottle number, which may be done through the new Satellite's user interface. | → ← | Operator sets bottle number on individual Satellite LED's. |
| Dispense (relative volume, 1-10) | → | Tells Satellite how much to dispense for first bottle by running pump to lookup table ("LUT") values |
| Second Bottle to be dispensed (bottle number) | → ← | Same operation as First bottle function. See above. |
| Dispense (relative volume, 1-10) | → | Tells Satellite how much to dispense for second bottle by running pump to LUT values |
| Pre-dispense (time) | → | Tells Satellite how much to dispense by running pump prior to starting time count down |
| Post-dispense (time) | → | Tells Satellite how much to dispense by running pump at end of cycle |
| Rinse Time (time) | | |
| Current Method (displays method number) | | |
| Manual Dispense On/Off | → | Turns first pump on/off when pressed |

Figure 13A

| Master Control Dispenser ("MCD") | | Satellite(s) |
|---|---|---|
| Mode (Manual, Auto) | | |
| Platen Rinse (On/Off) | | |
| Name Bottle (1-10) | | |
| Select Language for LCD display (English, French, Spanish, Portuguese, German, Japanese, Korean, Chinese) | | |
| Maintain System<br>Stir Bottle (on/off)<br>Clean Bottle (on/off)<br>Satellite Bottle (on/off)<br>Exit<br>Stir (1-10, all)<br>Clean (1-10, all)<br>Prime (1-10, all)<br>Low Bottle Reset (1-10, all) | → | Performs various functions by turning the pumps forward and backward for LUT times according to functionality selected from priming, stirring, or cleaning individual or all bottles. |
| Method Load<br>Next Method<br>Previous Method<br>Load Method<br>Exit<br>MCD checks to see if, for a given method, the bottle numbers are present on the Satellites. If not, an error message is displayed to the operator.<br>Will detect new Satellites added and request the operator to name/identify them.<br>Will detect change in unit numbers. After matches will allow operator to proceed. | →<br>← | Sends bottle number present as programmed on LED's to MCD.<br>When queried by MCD will confirm a new unit has been added.<br>Sends any changed Satellite unit numbers to MCD. |
| Method Save<br>Previous Method<br>Save Method<br>Exit | | |
| Error messages, pump hours, low bottle message(s) and service diagnostics. MCD detects various problems with Satellite(s) and offers error messages to customer, service diagnostic functions, and displays total pump hours used. | ←<br>→ | Various information as desired. |

Figure 13B

| Grinder/Polisher(s) | | MASTER CONTROL DISPENSER | | SATELLITE(s) |
|---|---|---|---|---|
| | | Power On/Off via operator pressing on/off switch. Power supplied by wall outlet. | → | Power On/Off. Power supplied via 12V RJ45 plug and cable cord |
| Cycle ON/Off | → | Cycle On/Off | → | Turns one or more operator-selected Satellite pumps on at one time to start cycle. Time and volume may vary among the satellites. Start may be synchronized with on/off from Master Control Dispenser |
| | | First Bottle to be dispensed (bottle number)<br>After selected, MCD searches to see if this bottle number is present within the system. If the bottle is not present, the MCD may display an error message to the operator. If another Satellite is plugged into system, the MCD detects new Satellite and displays a message to operator to set the bottle number, which may be done through the new Satellite's user interface. | →<br>← | Operator sets bottle number on individual Satellite LED's. |
| | | Dispense (relative volume, 1-10) | → | Tells Satellite how much to dispense for first bottle by running pump to LUT values |

Figure 15A

| Grinder/Polisher(s) | | MASTER CONTROL DISPENSER | | SATELLITE(s) |
|---|---|---|---|---|
| | | Second Bottle to be dispensed (bottle number) | → ← | Same operation as First bottle function. See above. |
| | | Dispense (relative volume, 1-10) | → | Tells Satellite how much to dispense for second bottle by running pump to LUT values |
| | | Pre-dispense (time) | → | Tells Satellite how much to dispense by running pump prior to starting time count down |
| | | Post-dispense (time) | → | Tells Satellite how much to dispense by running pump at end of cycle |
| | | Rinse Time (time) | | |
| | | Current Method (displays method number) | | |
| | | Manual Dispense On/Off | → | Turns First pump on/off when pressed |
| | | Mode (Manual, Auto) | | |
| | | Platen Rinse (On/Off) | | |
| | | Name Bottle (1-10) | | |
| | | Select Language for LCD display (English, French, Spanish, Portuguese, German, Japanese, Korean, Chinese) | | |

Figure 15B

| Grinder/Polisher(s) | | MASTER CONTROL DISPENSER | | SATELLITE(s) |
|---|---|---|---|---|
| | | Maintain System<br>Stir Bottle (on/off)<br>Clean Bottle (on/off)<br>Satellite Bottle (on/off)<br>Exit<br>Stir (1-10, all)<br>Clean (1-10, all)<br>Prime (1-10, all)<br>Low Bottle Reset (1-10, all) | → | Performs various functions by turning the pumps forward and backward for LUT times according to the functionality selected from priming, stirring, or cleaning the individual or all bottles. |
| | | Method Load<br>Next Method<br>Previous Method<br>Load Method<br>Exit<br>Master Control Dispenser checks to see if, for a given method the bottle numbers are present on the Satellites. If not, Master Control Dispenser displays an error message to operator. Will detect new Satellites added and request the operator to name. Will detect change in unit numbers. After matches will allow operator to proceed. | →<br>← | Sends bottle number present as programmed on LEDs to Master Control Dispenser. When queried by Master Control Dispenser, satellite will confirm a new unit has been added. Sends any changed Satellite unit numbers to Master Control Dispenser. |
| | | Method Save<br>Previous Method<br>Save Method<br>Exit | | |

Figure 15C

| Grinder/Polisher(s) | | MASTER CONTROL DISPENSER | | SATELLITE(s) |
|---|---|---|---|---|
| | | Error messages, Pump hours, low bottle message(s) and service diagnostics. Master Control Dispenser detects various problems with Satellite(s) and provides error messages, service diagnostic functions, and displays total pump hours used. | → ← | Various information as desired. |

Figure 15D

| Grinder/Polisher | | MASTER CONTROL DISPENSER | | SATELLITE(s) |
|---|---|---|---|---|
| Power On/Off via operator pressing on/off switch. Power supplied by wall outlet. | → | Power On/Off via cue from Grinder/Polisher, power supplied by wall outlet. | → | Power On/Off Power supplied via 12V RJ45 plug and cable cord |
| Cycle On/Off pressed by operator | → | Cycle On/Off- software changes to reflect current state and activates Satellites | → | Turns one or more operator selected Satellite pumps on at one time to start cycle. Time and volume may vary among the satellites. Start may be synchronized with on/off from Master Control Dispenser |
| | | First Bottle to be dispensed (bottle number) After selected, MCD searches to see if this bottle number is present within the system. If the bottle is not present, the MCD may display an error message to the operator. If another Satellite is plugged into system, the MCD detects new Satellite and displays a message to operator to set the bottle number, which may be done through the new Satellite's user interface. | → ← | Operator sets bottle number on individual Satellite LED's. |
| | | Dispense (relative volume, 1-10) | → | Tells Satellite how much to dispense for first bottle by running pump to LUT values |

Figure 17A

| Grinder/Polisher | | MASTER CONTROL DISPENSER | | SATELLITE(s) |
|---|---|---|---|---|
| | | Second Bottle to be dispensed (bottle number) | → ← | Same operation as First bottle function. See above. |
| | | Dispense (relative volume, 1-10) | → | Tells Satellite how much to dispense for second bottle by running pump to LUT values |
| | | Pre-dispense (time) | → | Tells Satellite how much to dispense by running pump prior to starting time count down |
| | | Post-dispense (time) | → | Tells Satellite how much to dispense by running pump at end of cycle |
| | | Rinse Time (time) | | |
| | | Current Method (displays method number) | | |
| | | Manual Dispense On/Off | → | Turns First pump on/off when pressed |
| | | Mode (Manual, Auto) | | |
| | | Platen Rinse (On/Off) | | |
| | | Name Bottle (1-10) | | |
| | | Select Language for LCD display (English, French, Spanish, Portuguese, German, Japanese, Korean, Chinese) | | |

Figure 17B

| Grinder/Polisher | | MASTER CONTROL DISPENSER | | SATELLITE(s) |
|---|---|---|---|---|
| | | Maintain System<br>Stir Bottle (on/off)<br>Clean Bottle (on/off)<br>Satellite Bottle (on/off)<br>Exit<br>Stir (1-10, all)<br>Clean (1-10, all)<br>Prime (1-10, all)<br>Low Bottle Reset (1-10, all) | → | Performs various functions by turning the pumps forward and backward for LUT times according to functionality selected from priming, stirring, or cleaning individual or all bottles. |
| Operator loads a Default Grinder/Polisher Method. | →<br>← | Method Load<br>Next Method<br>Previous Method<br>Load Method<br>Exit<br>Satellite loads corresponding Default Dispensing Method for a given material, for example B1. Master Control Dispenser checks to see if for a given method the bottle numbers are present on the Satellites. If not, an error message to operator may be displayed on the Grinder/Polisher LCD. Master Control Dispenser may detect new Satellites added and may request the operator to name/identify them. Will detect change in unit numbers. After matches, error message may disappear on Grinder/Polisher LCD and may allow operator to proceed. | →<br>← | Sends bottle number present as programmed on LEDs to Master Control Dispenser. When queried by Master Control Dispenser will confirm a new unit has been added. Sends any changed Satellite unit numbers to Master Control Dispenser. |

Figure 17C

| Grinder/Polisher | | MASTER CONTROL DISPENSER | | SATELLITE(s) |
|---|---|---|---|---|
| | | Method Save<br>Previous Method<br>Save Method<br>Exit | | |
| | | Error messages, pump hours, low bottle message(s) and service diagnostics. Master Control Dispenser detects various problems with Satellite(s) and offers error messages to customer, service diagnostic functions, and displays total pump hours used. | ⇄ | Various information as desired. |
| Dispenser (Satellite or Master Control Dispenser) Checks whether a Master Control Dispenser, as opposed to a different type of dispenser, is attached. Automatically activates those portions of the software that work with a Master Control Dispenser. If another type of dispenser is present, deactivates non compatible features such as paired default grinder/polisher and dispensing methods. | → ← | Indicates Master Control Dispenser is present to Grinder/Polisher. Checks for presence of Satellite(s) | → ← | Indicates Satellite(s) are present to Master Control Dispenser |

Figure 17D

MODULAR FLUID-DISPENSING SYSTEM

CROSS REFERENCE TO RELATED APPLICATIONS

This application claims priority to provisional application Ser. No. 60/335,325, filed Nov. 2, 2001, entitled Modular Fluid-Dispensing System, which is incorporated herein by reference.

This application is related to application Ser. No. 10/282,499, filed with this application, entitled Modular Fluid-Dispensing System.

FIELD OF THE INVENTION

The invention relates to a system, and components of a system, for dispensing solutions, such as those commonly used with a grinder/polisher for preparing metallographic and other materiallographic samples.

BACKGROUND OF THE INVENTION

Users of grinder/polishers and dispensers typically include manufacturers of metals, polymers, ceramics or other materials used for building many different types of products. Metallographic laboratories and production-support laboratories or quality-assurance/quality-control laboratories use sample-preparation systems to grind materials to a near-mirror-like finish before examining the microstructure of the materials to assess adherence to quality-control standards. Fluid dispensers are used for dispensing abrasive solutions onto a rotating platen or cloth used for grinding/polishing the material samples.

Conventional solution-dispensing systems typically have various shortcomings associated with them. For instance, a conventional solution dispenser, named Multidoser, is available from Struers USA, which is headquartered in Denmark; has an office in Westlake, Ohio; and was recently purchased by Roper Industries of Bogart, Georgia. The Multidoser can be purchased in either a 3-bottle version or a 6-bottle version. The 3-bottle version can be used to dispense up to 3 solutions simultaneously. Similarly, the 6-bottle version can be used to dispense up to 6 solutions simultaneously. The 3-bottle version cannot, however, be upgraded to the 6-bottle version without significant effort. Regardless of which version is purchased, the Multidoser is sold in a cabinet large enough to accommodate 6 solution bottles. Under some circumstances, therefore, the Multidoser will waste laboratory space near a grinder/polisher.

A solution-dispensing system that provides more flexibility in allowing users to incrementally add solution-dispensing capacity, allows users to apportion bottles of solution flexibly between any number of grinder/polishers, and uses space efficiently would, therefore, be desirable.

A memory-and-control unit, called RotoCom, is available from the makers of the Multidoser. The RotoCom can be used for programming the Multidoser and a grinder/polisher to perform multi-step materials-preparation methods, including multiple-step dispensing methods performed in synchronization with multiple-step grinder/polisher methods. Some grinder/polishers, though, store pre-defined multiple-step grinding/polishing methods. This renders programmability of a grinder/polisher by a unit separate from the grinder/polisher unnecessary. This unnecessary functionality, namely, programmability of a grinder/polisher from a unit separate from the grinder/polisher, undesirably increases the cost associated with adding fluid-dispensing programmability by requiring a customer to purchase grinder/polisher programmability even though the customer wants to add only fluid-dispensing programmability.

A more cost-effective way of adding programmability to a fluid-dispensing system would therefore be desirable.

Single-bottle fluid dispensers are well known in the art. Some of these conventional single-bottle fluid dispensers do not, however, communicate with, and/or operate in synchronization with, other fluid dispensers. When using several of these conventional single-bottle fluid dispensers together, each dispenser would have to be manually started and manually stopped for each fluid-dispensing step. In addition to being inconvenient to the user or operator of the fluid-dispensing system, manually stopping multiple single-bottle dispensers wastes abrasive solution, which is expensive. Fluid dispensers that cannot automatically stop dispensing fluid after an operator-selectable dispensing duration undesirably create a situation in which the operator needs to be present solely to manually stop the dispenser. If the operator wants or needs to walk away from the grinder/polisher during operation and the dispenser cannot be programmed to automatically stop dispensing fluid, the dispenser may continue dispensing fluid longer than desired thereby wasting fluid. Further, without such an automatic shutoff, the operator might have to stop in the middle of a step, and repeat that step later, wasting expensive abrasive and time. Being able to specify when the dispenser will automatically shutoff would therefore be desirable.

A different type of single-bottle fluid dispenser can be coupled to another dispenser that issues commands to the single-bottle fluid dispenser to start dispensing, stop dispensing, set a dispensing rate, and set a dispensing duration. This type of single-bottle fluid dispenser, however, does not run in a stand-alone mode in which it is not under the control of another dispenser. A cost issue therefore arises because a more expensive programmable unit is needed for controlling this type of single-bottle dispenser. Further, this kind of single-bottle fluid dispenser does not communicate any information, such as a bottle identifier, back to the dispenser that is controlling it. This lack of bi-directional communication limits the controller's ability to detect error conditions and to control the single-bottle dispensers in ways that require bi-directional communication.

Accordingly, a space-efficient single-bottle fluid dispenser capable of running in stand-alone mode and communicating bi-directionally with, and/or running in synchronization with, one or more other fluid dispensers would be desirable.

Conventional fluid dispensers typically do not monitor the volume of fluid in the dispenser bottles or provide a warning to an operator when the fluid level becomes low. Monitoring fluid levels and providing this type of warning would be desirable because, if a bottle runs out of fluid during a grinding/polishing operation, the samples could easily be ruined. This could be very expensive because new specimens might have to be obtained, the entire grinding/polishing process might have to be restarted from the beginning, and production go/no decisions could be delayed. In addition, heat could be generated that might damage the expensive consumable surface, to which the abrasive is applied, thereby requiring replacement.

BRIEF SUMMARY OF THE INVENTION

A system in accordance with illustrative embodiments of the invention may include one or more satellite dispensers and/or a master control dispenser for applying fluids, such as liquid abrasive solutions, lubricants, water, and rinses, to a surface used for grinding and/or polishing materials.

The master control dispenser is programmable and may dispense one or more solutions. Satellites may communicate bi-directionally with the master control dispenser. Each satellite may dispense fluid from a single bottle. In this context, the terms fluid and solution include, but are not limited to various diamond, alumina (AL2O3), silicon carbide (SiC), silicon dioxide (SiO2), and other abrasive suspensions; lubricants; and the like. The master control dispenser and satellites may use peristaltic pumps. The master control dispenser may store various multi-step dispensing methods and may automatically advance a dispensing method to a next step. The master control dispenser may refrain from activating a next step until the master control dispenser receives an indication from the operator or a command from a grinder/polisher. A grinder/polisher may control the dispensing methods and semi-automatically start, stop, repeat, and progress a fluid-dispensing method to a subsequent step. The master control dispenser may control an amount of solution dispensed for a method selected by the operator.

The modularity of the satellites and the master control dispenser advantageously provides a system user with extraordinary flexibility in assembling a system according to the number of solutions the user would like the system to dispense. In accordance with the invention, a system user may configure an inexpensive system with one satellite running in a stand-alone mode. The user could eventually expand up to full automation (i.e., programmability by a master control dispenser, semi-automatic control by a grinder/polisher, etc.) and many solutions dispensed. This flexibility represents a significant advantage over conventional systems that typically include only an entire dispenser as-is from the factory with no potential for upgrading.

BRIEF DESCRIPTION OF THE DRAWINGS

FIG. 7 depicts data flow between the grinder/polisher and satellite dispensers of FIG. 6.

FIGS. 13A–13B depict data flow between the master control dispenser and the satellite dispensers of FIG. 12.

FIGS. 15A–15D depict data flow between the grinder/polishers, the master control dispenser, and the satellite dispensers of FIG. 14.

FIGS. 17A–17D depict data flow between the grinder/polisher, master control dispenser, and satellite dispensers of FIG. 16.

DETAILED DESCRIPTION OF THE INVENTION

Figure 1:
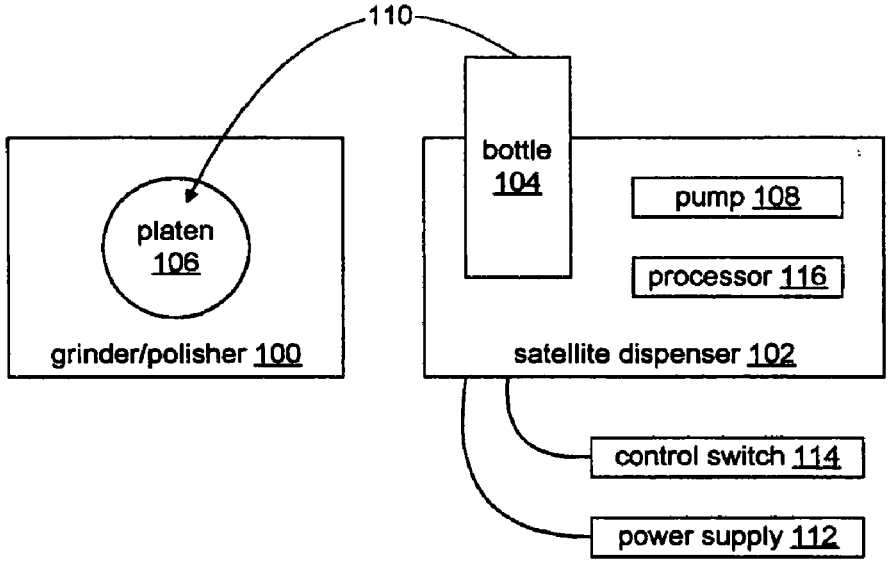
FIG. 1 schematically depicts a grinder/polisher and a satellite dispenser in accordance with an illustrative embodiment of the invention.

Referring to FIG. 1, a grinder/polisher 100 and a satellite dispenser 102, in accordance with an illustrative embodiment of the invention, are schematically shown. The curved arrow 110 from the satellite's bottle 104 to the grinder/polisher's platen 106 represents a tube through which the satellite provides fluid from the bottle 104 to the platen 106. The satellite includes a peristaltic pump 108 that sucks fluid from the bottle 104 and pumps the fluid through the tube to the grinder/polisher 100. Of course, other suitable types of pumps could also be used.

An external power supply 112 is shown in FIG. 1. The power supply 112 could be a 12-volt DC transformer that is plugged into a regular 120 Volts AC electrical outlet or any other voltage supplied worldwide. The satellite may be a universal-voltage device, which means that it may operate properly while accepting a very broad range of input voltages.

A control switch 114 is also shown in FIG. 1. A person operating the satellite dispenser can activate the control switch to cause the satellite to either start or stop dispensing fluid. This is referred to as a manual mode of operation.

When a satellite runs in a stand-alone mode (i.e., not under the control of another fluid-dispensing-system component), a processor 116 in the satellite 102 may reference a lookup table containing pump-on and pump-off times associated with a qualitative setting selected by a person operating the satellite dispenser 102. Of course, control of pump-on and pump-off times by the processor 116 could be performed in many other ways that are well known in the art. The processor 116 could be a microprocessor, a microcontroller, a digital signal processor, and the like.

Figure 2:
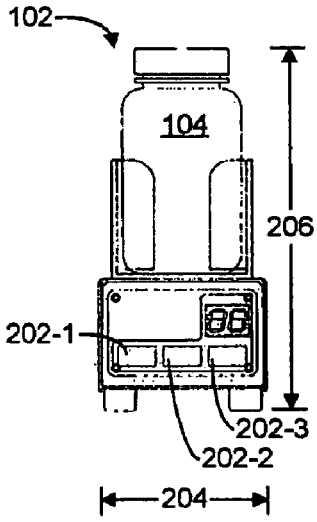
FIG. 2 is a front elevational view of a satellite dispenser in accordance with an illustrative embodiment of the invention.

An operator can specify a qualitative dispensing rate via a user interface, such as the 2-digit display and the 3 buttons 202-1 through 202-3 shown on the front of satellite 102 shown in FIG. 2. An indicator, such as an icon or a dot between the digits, may be illuminated to indicate to an operator that the satellite dispenser 102 is operating in stand-alone mode. The operator may select a qualitative dispensing rate, for instance from 0 through 9. This setting may then be displayed, for instance on the LED-digit to the left in FIG. 2. Qualitative settings for dispensing rates or amounts are commonly used for fluid-dispensing systems. Of course, other dispensing parameters, such as an elapsed dispensing time, an amount of fluid dispensed, and the like, may also be displayed.

Similarly, an operator may program the satellite to dispense fluid for an operator-selectable number of minutes, for instance from 1 to 9, which may be displayed on the LED-digit to the right in FIG. 2. Limiting the number of minutes the pump will operate advantageously prevents the pump from pumping for long periods of time, which can waste fluid under certain circumstances, such as when the operator has left the grinder/polisher 100 and satellite 102 unattended for an extended period of time.

An operator may use one of the buttons 202 on the front of the satellite 102 to reverse the direction of the pump 108. This is useful for cleaning the tubing to prevent clogging and for stirring the fluids.

The satellite dispenser 102 may be relatively compact. For instance, it may have dimension of approximately 4 inches wide (horizontally in FIG. 2), approximately 5.5 inches deep (horizontally in FIG. 3), and approximately 9 inches high (vertically in FIGS. 2 and 3), including the height of the bottle 104. These dimensions are depicted in FIGS. 2 and 3 by dimension arrows 204, 300, and 206, respectively.

Figure 3:
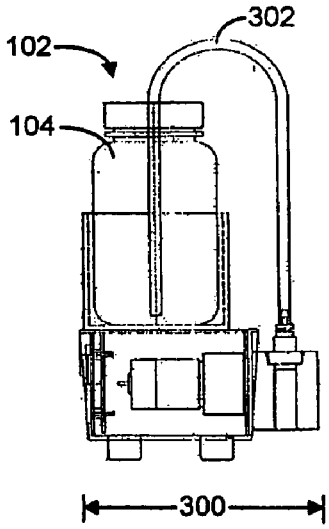
FIG. 3 is a side elevational view of a satellite dispenser in accordance with an illustrative embodiment of the invention.

FIG. 3 is a side view of the satellite dispenser 102 shown in FIG. 2 showing a tube 302 leading from the bottle 104 to an inlet of the satellite's pump 108.

As will be apparent, a satellite dispenser 102 could be used for applications other than in conjunction with a grinder/polisher 100. For instance, a satellite dispenser 102 could be used with a drill press or any other suitable type of equipment.

Figure 4:
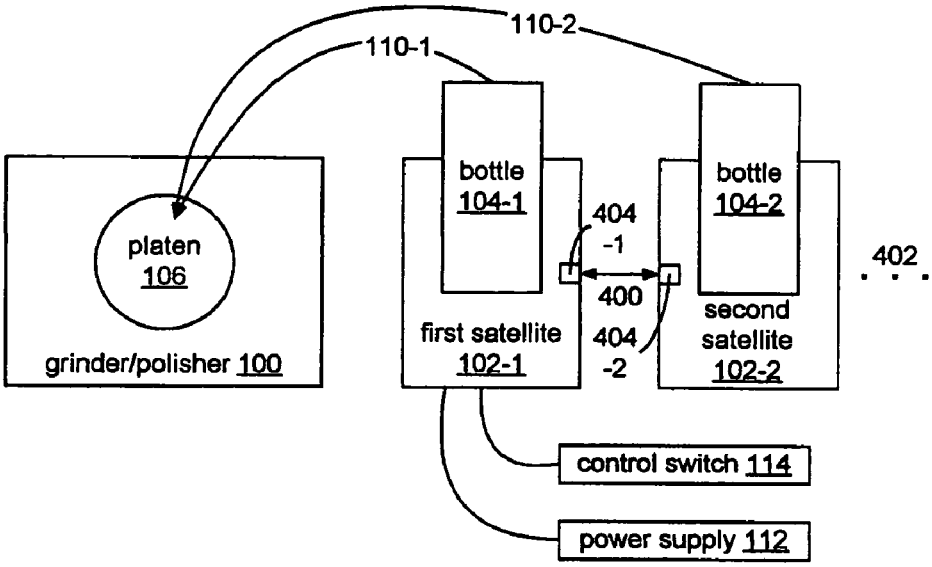
FIG. 4 schematically depicts a grinder/polisher and multiple satellite dispensers in accordance with an illustrative embodiment of the invention.

FIG. 4 schematically shows a first satellite 102-1 and a grinder/polisher 100, as in FIG. 1. FIG. 4 also shows a second satellite 102-2 coupled to the first satellite 102-1 via a coupling 400, which may include a serial communication link. The coupling 400 may terminate at first and second coupling ports 404-1 and 404-2. Similar couplings are illustrated throughout various other Figures. In an attempt to keep the other Figures uncluttered, the coupling ports are not shown in the other Figures. That such coupling ports may be included with the embodiments shown in the other Figures, however, is presumed. As will be apparent any suitable type of coupling, such as an infrared or fiber-optic link, may be included between various fluid-dispensing system components.

Coupling 400 may be an 8-conductor cable with RJ-45 connectors at both ends. Of course, other suitable ways of coupling the satellites 102 could also be used. Power from the power supply 112 may be transferred between the first satellite 102-1 and the second satellite 102-2 via the coupling 400.

The first satellite 102-1 may notify the second satellite 102-2 over a serial communication link of coupling 400 when an operator activates the control switch 114. In this manner, the operator can start both satellites in synchronization with each other by activating the single control switch 114. Satellites configured as in FIG. 4 very cost-effectively provide the ability to dispense 2 different fluids simultaneously at different dispensing rates. While the satellites are operating, the operator can stop both satellites in synchronization with each other by activating the control switch 114.

If the satellites are programmed to dispense fluid for different durations and the operator does not activate the control switch while the dispensers are operating, then the satellites will stop dispensing fluid after operating for their respective programmed durations.

The ellipses 402 to the right of the second satellite 102-2 in FIG. 4 represents that additional satellites could be coupled to the second satellite 102-2 and then to one another in the same manner that the second satellite 102-2 is coupled to first satellite 102-1. Serial communication of control-switch activations and sharing of electrical power from the power supply 112 may then be provided from the first satellite 102-1 to multiple other satellites in a manner similar to that described above for the second satellite 102-2.

Figure 5:
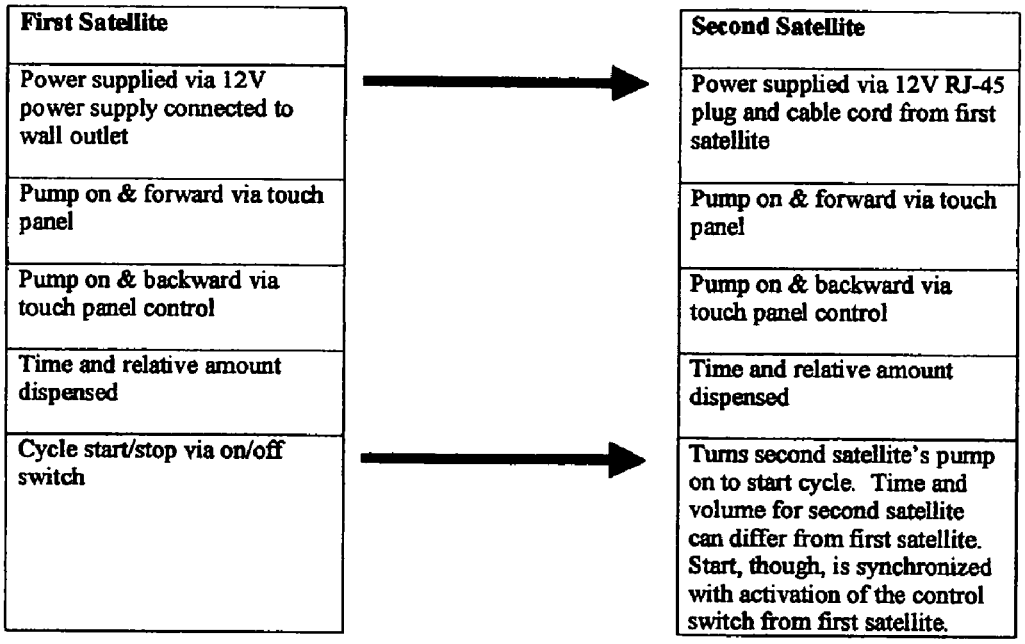
FIG. 5 depicts data flow between the satellite dispensers of FIG. 4.

For a fluid-dispensing system such as the one shown in FIG. 4, FIG. 5 depicts settings that may be configured independently for each satellite 102, how the satellites 102 may receive power from the power supply 102, and what information may be passed in which direction between the satellites 102. Rows without an arrow indicate independent control and a lack of communication between the satellites 102 for the subject matter of those rows.

Figure 6:
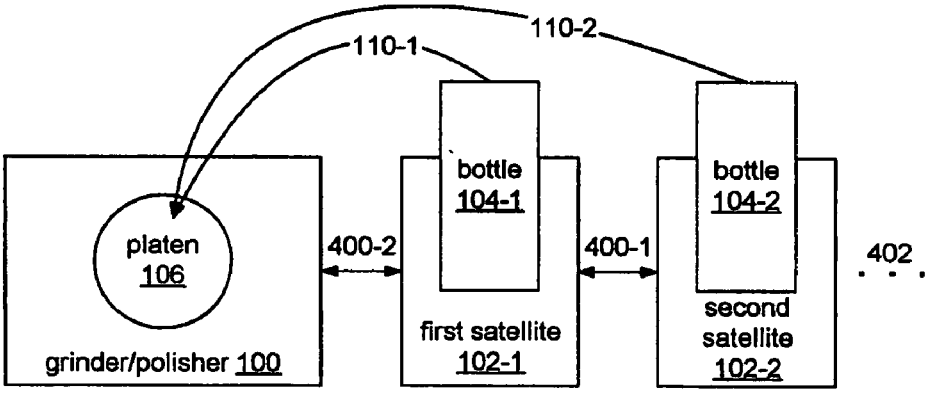
FIG. 6 schematically depicts a grinder/polisher and multiple satellite dispensers in accordance with an illustrative embodiment of the invention.

FIG. 6 schematically depicts a configuration similar to the configurations of FIGS. 1 and 4 except the control switch 114 and power supply 112 are replaced by a coupling 400-2, which may include a serial communication link, between the grinder/polisher 100 and the first satellite 102-1. With one or more satellites 102 coupled to the grinder/polisher 100 and one another, as described above in connection with FIG. 4, the grinder/polisher 100 can pass power from a wall outlet through the couplings 400 to the satellites 102. In this way, a single power button on the grinder/polisher 100 can power on and off the satellites 102 along with the grinder/polisher 100. The grinder/polisher 100 may also automatically issue cycle start/stop commands over a serial communication link of the couplings 400 to the satellites 102 with these commands having the same effect as if an operator activated the control switch 114 of FIG. 4.

For a fluid-dispensing system such as the one shown in FIG. 6, FIG. 7 depicts settings that may be configured independently for the grinder/polisher 100 and each satellite 102; how the satellites 102 may receive power from the grinder/polisher 100; and what information may be passed in which direction from the grinder/polisher 100 to the satellites 102 and among the satellites 102. Rows without an arrow indicate independent control and a lack of communication between the grinder/polisher 100 and satellites 102 for the subject matter of those rows.

Figure 8:
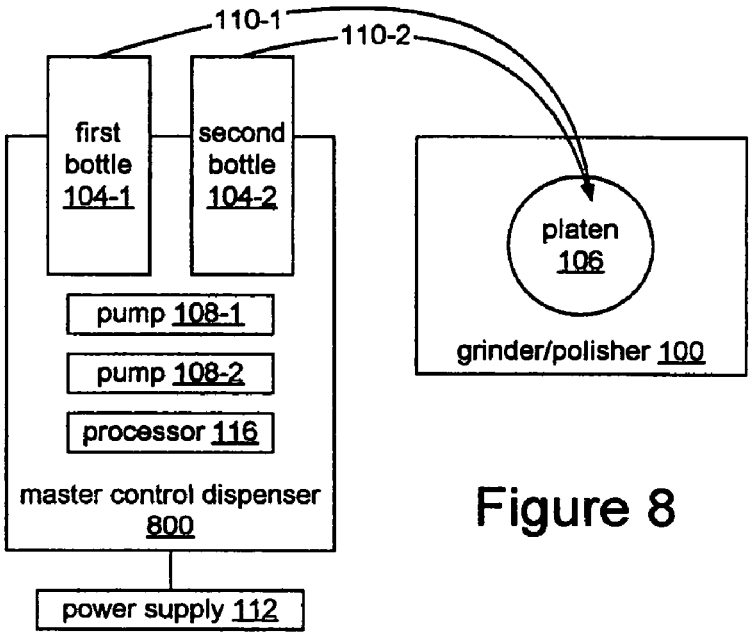
FIG. 8 schematically depicts a grinder/polisher and master control dispenser in accordance with an illustrative embodiment of the invention.

FIG. 8 schematically depicts a master control dispenser 800, in accordance with an illustrative embodiment of the invention, having two bottles 104-1 and 104-2 of solution. The solution is pumped to the platen 106 of the grinder/polisher 100 in a manner similar to that described above for the satellite dispenser 102. The master control dispenser 800 may include two pumps 108-1 and 108-2; one for each bottle 104 shown in FIG. 8. As will be apparent a master control dispenser could include any suitable number of bottles, such as 1.

The master control dispenser 800 may receive power from a wall-outlet power supply 112. An operator may manually start respective pumping cycles for both bottles 104 at the same time or at different times.

The master control dispenser 800 may allow an operator to program several parameters related to dispensing fluid and system maintenance. Both bottles 104 may be identified by a unique bottle number as part of the process of configuring the master control dispenser 800. For both bottles 104, a relative qualitative dispensing volume, for instance a value from 1 to 10, may be selected.

A user may select, or load, a stored preprogrammed multiple-step dispensing method. Such a method may be either a default method or a user-defined method. The master control dispenser 800 may display the currently loaded, or selected, method. An operator may select the following method-loading-menu entries: Next Method; Previous Method; Load Method; and Exit. An operator may select the following method-saving-menu entries: Next Method, Previous Method; Save Method; and Exit.

Additional parameters that may be configured or specified by a user include: Pre-Dispense (time); Rinse (time); Current Method (displays method number); Manual Dispense On/Off; Mode (Manual, Auto); Platen Rinse (On/Off); Name Bottle (1–10); and Select Language for LCD display (English, French, Spanish, Portuguese, German, Japanese, Korean, or Chinese).

The following system maintenance parameters may be set by an operator: Stir Bottle (bottle number or all bottles); Clean Bottle (on/off); Name Bottle (select bottle name and abrasive size, example 6 um Diamond, 1 um Al2O3, 0.05 um SiO2, 15 um SiC); Exit; Stir (bottle number or all bottles); Clean (bottle number or all bottles); and Prime (bottle number or all bottles).

Figure 9:
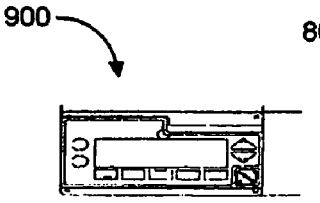
FIGS. 9–11 show a fascia, a side elevational view, and a back elevational view, respectively, of a master control dispenser in accordance with an illustrative embodiment of the invention.
Figure 10:
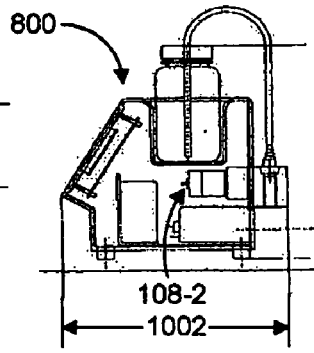
Figure 11:
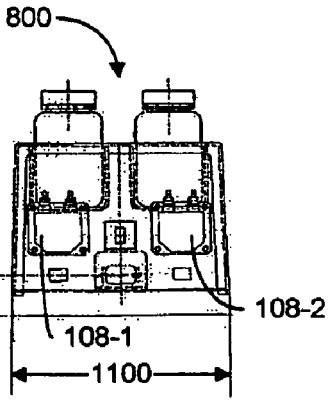

FIGS. 9–11 show a fascia 900, a side view, and a back view, respectively, of a master control dispenser 800 in accordance with an illustrative embodiment of the invention.

Like a satellite 102, a master control dispenser 800 may be a universal voltage device and may be compact; measuring less than 10 inches deep (horizontally in FIG. 10) and less than 9.5 inches wide at its base (horizontally in FIG. 11). These dimensions are depicted in FIGS. 10 and 11 by dimension arrows 1002 and 1100, respectively.

The master control dispenser 800 may have a water purge feature on one or more of the bottles. This feature may include a valve that opens to flush solution from the tubing with tap water. This feature may be used to reduce clogging when using solutions that are prone to clogging. The pumps 108 may then be reversed to suck water back through the tubing thereby removing the water and clearing the tubes in preparation for pumping in a different fluid.

Figure 12:
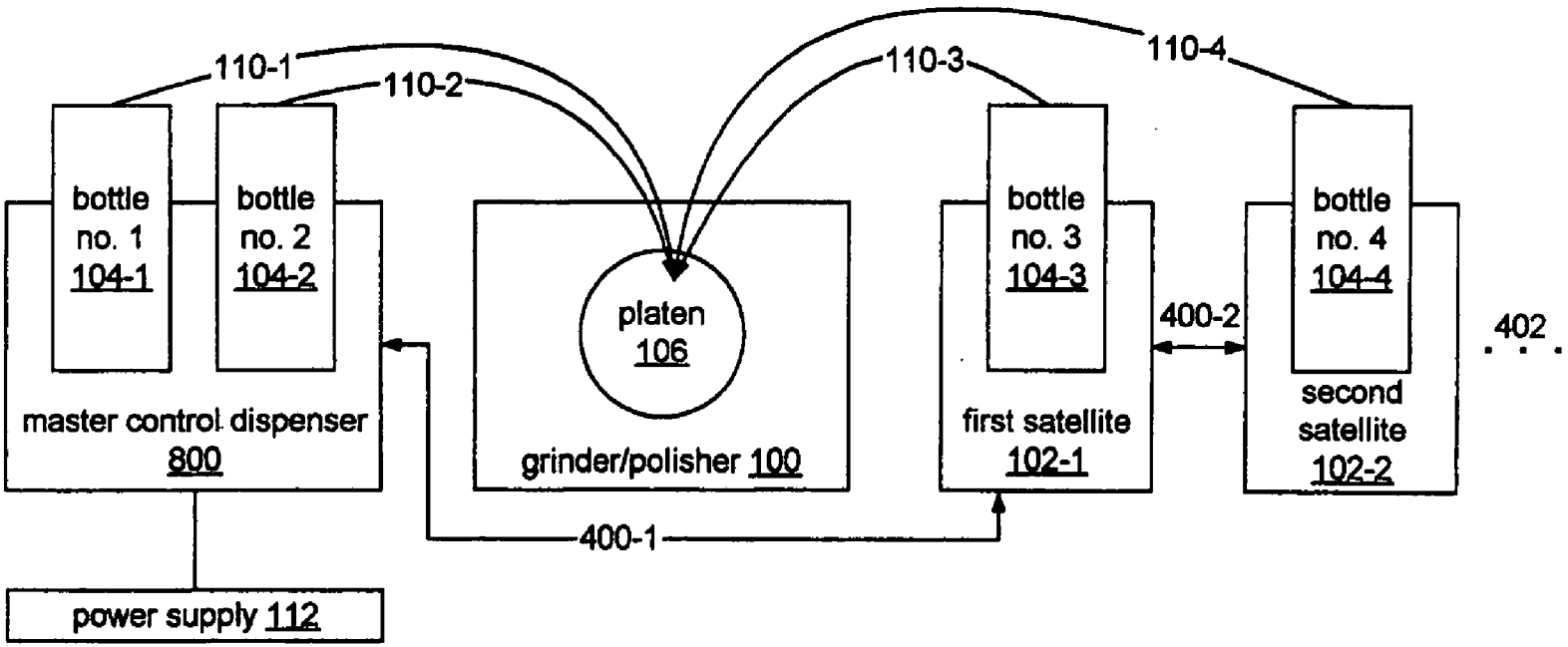
FIG. 12 schematically depicts a master control dispenser, a grinder/polisher, and multiple satellite dispensers in accordance with an illustrative embodiment of the invention.

FIG. 12 schematically depicts a master control dispenser 800 coupled to multiple satellites 102 via couplings 400-1 and 400-2, which may include serial communication links. Through these couplings 400, the master control dispenser 800 may pass power from the power supply 112 to the satellites 102. In this manner, an operator may use a single power button on the master control dispenser 800 for powering on and off the master control dispenser 800 and one or more satellites 102 coupled to the master control dispenser 800.

In accordance with an illustrative embodiment of the invention, while coupled to a master control dispenser 800, as shown in FIG. 12, the master control dispenser 800 may individually start and stop addressed satellites 102. In this mode, one or more of the satellites 102 may be "slaved to" the master control dispenser 800. The master control dispenser 800 may transmit commands to the satellites 102 to turn their pump motors on for a predetermined amount of time. This may be implemented through a lookup table containing low-level motor-on and motor-off times or durations specified in millisecond increments. The master control dispenser 800 may use such a lookup table for particular process steps associated with multi-step dispensing methods. Satellites 102 may not know which multiple-step stored fluid-dispensing method they are performing. Each satellite 102 may have knowledge of cycle-on or cycle-off status, relative dispensing amount and duration, and what bottle number serves as the satellite's identifier.

Of course other suitable strategies could also be used for controlling the dispensing activity of the satellites 102. For instance, the master control dispenser 800 could communicate to the satellites 102 which multiple-step stored method is being performed.

Each qualitative dispensing amount, which may be specified in a range of values such as 0–9, 1–10, or any other suitable range, may correspond to a single dispensing amount regardless of whether it is specified for a bottle at the main control dispenser 800 or at a satellite dispenser 102.

For a system as configured in FIG. 12, an operator may enter bottle numbers into each satellite 102 through each satellite's user interface. The master control dispenser 800 may check periodically to determine whether any new satellites 102 have been coupled to the system and/or whether any satellites 102 have been removed. The master control dispenser 800 may use this information to detect error conditions, such as trying to perform default and/or user-defined pre-programmed dispensing methods that require a predefined number of bottles 104 when fewer than the predefined number of bottles 104 are programmed into or present in the system. Upon detecting this type of error, the master control dispenser 800 may provide the operator with an error message until the error condition is remedied.

For a fluid-dispensing system such as the one shown in FIG. 12, FIGS. 13A and 13B depict settings that may be configured independently for a master control dispenser 800 and one or more satellites 102, how the satellites 102 may receive power from the master control dispenser 800, and what information may be passed in which directions between the master control dispenser 800 and the satellites 102. Rows without an arrow indicate independent control and a lack of communication between the master control dispenser 800 and the satellites 102 for the subject matter of those rows.

Figure 14:
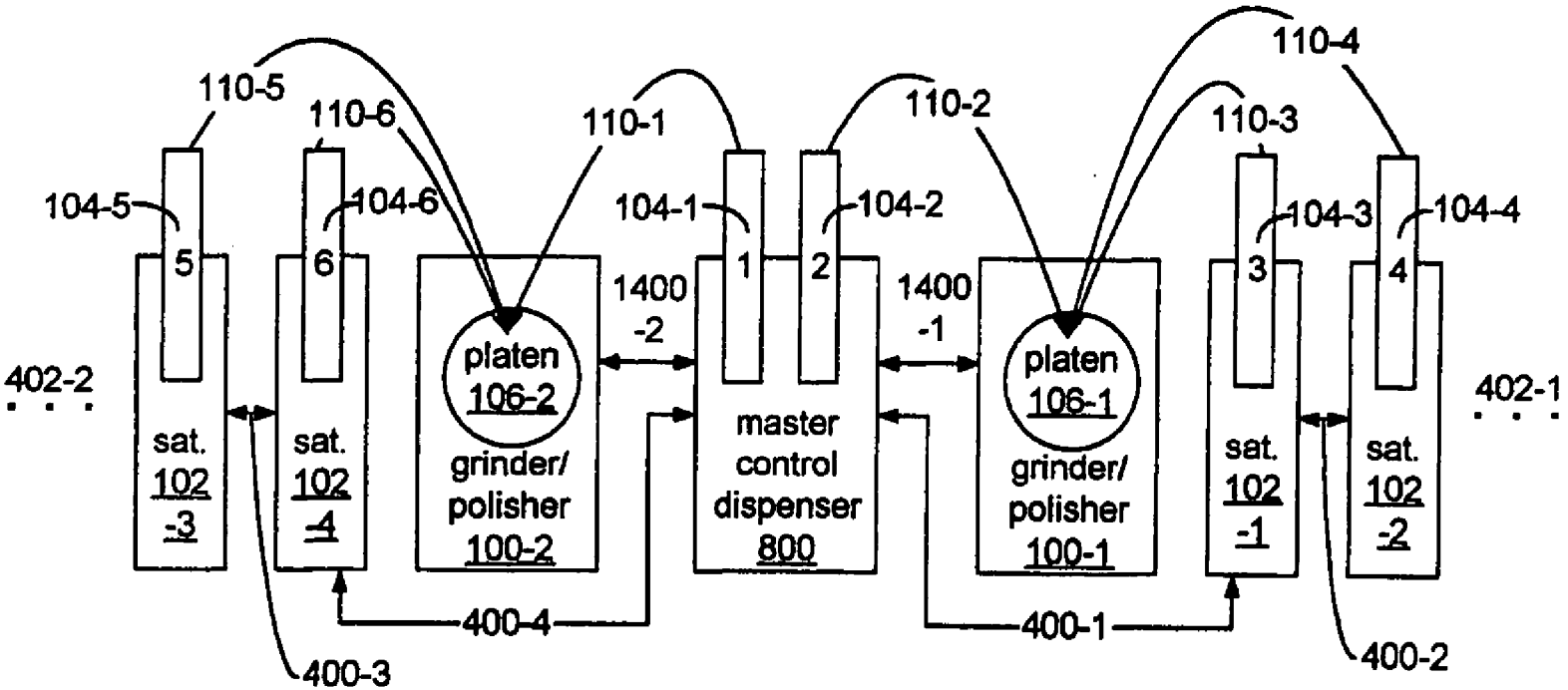
FIG. 14 schematically depicts a master control dispenser, multiple grinder/polishers, and multiple satellite dispensers in accordance with an illustrative embodiment of the invention.

As is schematically depicted in FIG. 14, a master control dispenser 800, in accordance with an illustrative embodiment of the invention, may accept inputs from multiple grinder/polishers 100. The master control dispenser 800 may then be used to distribute the solutions in any possible combination between the two grinder/polishers 100. Assuming 8 satellites 102 are coupled to the master control dispenser 800, the respective number of solutions dispensed to each of the respective grinder/polishers 100 could be 9 versus 1,8 versus 2,7 versus 3, etc. A first coupling 1400-1 and a second coupling 1400-2, between the master control dispenser 800 and the first and second grinder/polishers 100-1 and 100-2, respectively, may include respective serial communications links for transferring data as described below.

For a fluid-dispensing system such as the one shown in FIG. 14, FIGS. 15A–15D depict settings that may be configured independently for one or more grinder/polishers 100, a master control dispenser 800, and one or more satellites 102; how the satellites 102 may receive power from the master control dispenser 800, and what information may be passed in which directions between the grinder/polishers 100, the master control dispenser 800, and the satellites 102. Rows without an arrow indicate independent control and a lack of communication between the grinder/polishers 100, the master control dispenser 800, and the satellites 102 for the subject matter of those rows.

Figure 16:
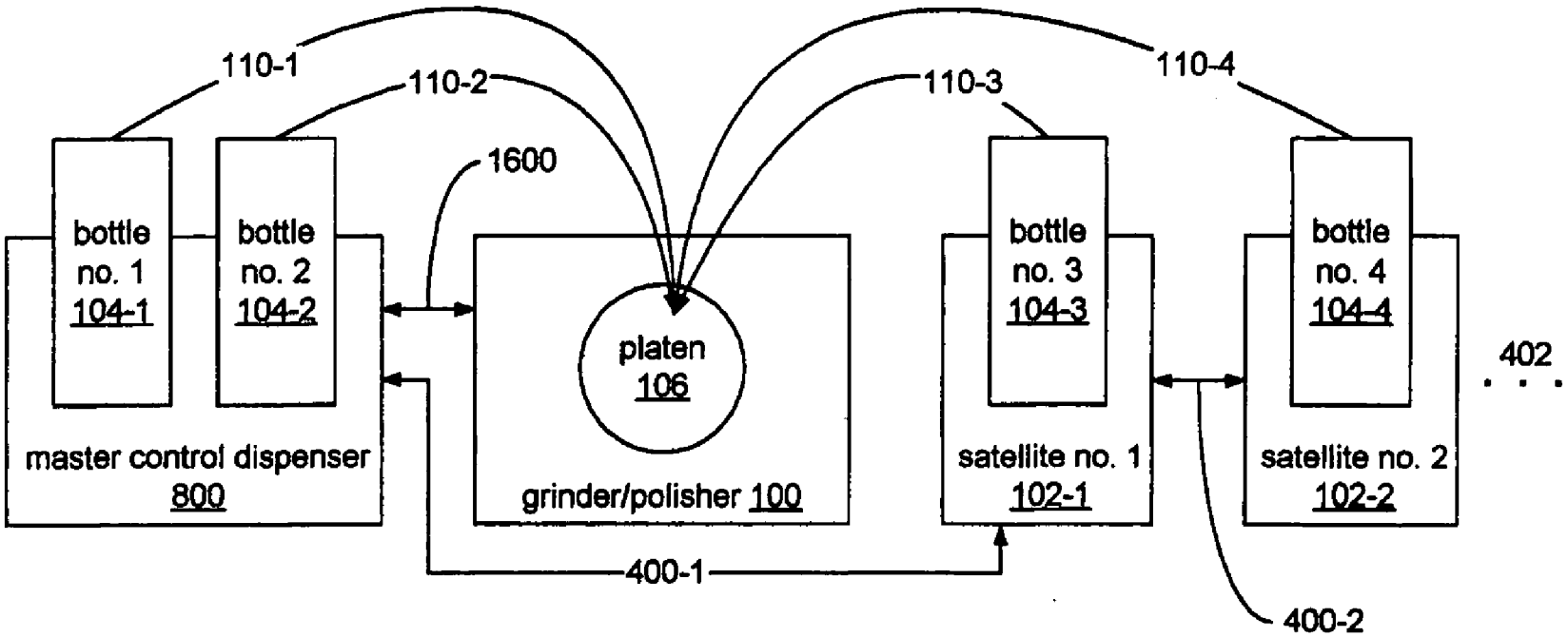
FIG. 16 schematically depicts a master control dispenser, a grinder/polisher, and multiple satellite dispensers in accordance with an illustrative embodiment of the invention.

FIG. 16 schematically depicts an illustrative embodiment of the invention similar to the embodiment shown in FIG. 12 except that a coupling 1600, which may include a serial communication link, is shown in FIG. 16 between the grinder/polisher 100 and the master control dispenser 800.

In accordance with the embodiment depicted in FIG. 16, coordinated predefined polishing and dispensing methods may be stored in the grinder/polisher 100 and the master control dispenser 800, respectively. For instance, separate pairs of grinder/polisher and dispensing methods could be defined for preparing metals, ceramics, polymers, and other material samples. These methods may include different types and amounts of abrasive solutions and different grinder/polisher speeds. The grinder/polisher 100 may communicate a selected predefined method to the master control dispenser 800 over the serial communication link of coupling 1600 to initiate execution of a grinder/polisher and a corresponding fluid-dispensing method in synchronization.

The master control dispenser 800 may automatically advance a multi-step fluid-dispensing method from a currently executing step to a next step. Alternatively, the master control dispenser 800 may advance a multi-step fluid-dispensing method from a currently executing step to a next step based on a grinder/polisher-to-master control dispenser progress-to-next-step signal received by the master control dispenser 800 from the grinder/polisher 100. The master control dispenser may send to one or more satellites 110 a master control dispenser-to-satellite progress-to-next-step signal based on having received the grinder/polisher-to-master control dispenser progress-to-next-step signal.

The master control dispenser may activate and/or deactivate a fluid dispensing cycle based on a grinder/polisher-to-master control dispenser cycle-on/off signal received by the master control dispenser 800 from the grinder/polisher 100. The master control dispenser 800 may send to at least one satellite 102 a master control dispenser-to-satellite cycle-on/off signal based on having received the grinder/polisher-to-master control dispenser cycle-on/off signal. The master control dispenser may send a cycle-start signal to a first satellite dispenser 102-1 and to a second satellite dispenser 102-2 thereby causing the first satellite 102-1 to start a first fluid-dispensing cycle and causing the second satellite 102-2 to start a second fluid-dispensing cycle. The first fluid-dispensing cycle and the second flu id-dispensing cycle may start in synchronization at substantially the same time. The duration of the first fluid-dispensing cycle may be different than the duration of the second fluid-dispensing cycle. Similarly, the dispensing rate of the first fluid-dispensing cycle may be different than the dispensing rate of the second fluid-dispensing cycle.

For a fluid-dispensing system such as the one shown in FIG. 16, FIG. 17 depicts settings that may be configured independently for one or more grinder/polishers 100, a master control dispenser 800, and one or more satellites 102; how the satellites 102 may receive power from the master control dispenser 800, and what information may be passed in which directions between the grinder/polishers 100, the master control dispenser 800, and the satellites 102. Rows without an arrow indicate independent control and a lack of communication between the grinder/polisher 100, the master control dispenser 800, and the satellites 102 for the subject matter of those rows.

As previously discussed, the master control dispenser 800 may check to determine whether any new satellites 102 have been added to the system and/or whether any satellites 102 have been removed. The master control dispenser 800 then may use this information to detect error conditions associated with trying to perform dispensing methods that require a predefined number of bottles 104 when fewer than the predefined number of bottles 104 have been entered into the system. Upon detecting this type of error in a configuration similar to FIG. 16, the master control dispenser 800 may communicate the error condition to the grinder/polisher 100.

The master control dispenser 800 may recognize when fluid in one or more of the bottles 104 is low by tracking the volume pumped from one or more bottles 104 over time. The amount of fluid dispensed can be calculated based on a user-selected relative volume and a look-up table that controls the pump activation and hence the volume of fluid that is dispensed over time. An amount dispensed may be stored in a computer-readable medium or in any other suitable way for each bottle 104. When a calculated amount of fluid dispensed indicates that a volume of fluid left in a bottle 104 has gone below a threshold, a warning message may be sent to the operator via the master control dispenser's user-interface display or via the grinder/polisher's user-interface display. The message may prompt the user to refill the bottle. After refilling the bottle with fluid, the operator may reset the fluid-level monitoring settings via a Low-Bottle-Reset function in a maintenance area of a master control dispenser's user interface. Of course, monitoring for low fluid levels within one or more bottles could also be done in other suitable ways. For example, individual satellites could individually monitor their own fluid levels and activate their own warning indicators when appropriate.

While the invention has been described with respect to specific examples including presently preferred modes of carrying out the invention, those skilled in the art will appreciate that there are numerous variations and permutations of the above described systems and techniques that fall within the spirit and scope of the invention. For instance, the control functions performed by a master control dispenser could be implemented as part of a control unit separate from any of the dispensers. Such a control unit could be stand-alone or could be incorporated into a grinder/polisher.

We claim:

1. A fluid-dispensing system comprising:

a master control dispenser that dispenses fluid from at least one master-control-dispenser fluid container;

wherein the master control dispenser includes:

a master-control-dispenser processor that is separate from a grinder/polisher, at least one pump coupled to the at least one master-control-dispenser fluid container;

a first coupling port that accepts a coupling to one or more other fluid-dispensing-system components; and wherein the master control dispenser can send and receive fluid-dispensing control information to and from at least one satellite dispenser that is separate from the master control dispenser.

2. The fluid-dispensing system of claim 1, wherein the fluid-dispensing control information is selected from the group consisting of: a cycle on/off signal, satellite dispenser identification information; and a progress-to-next-step signal for a multi-step fluid-dispensing method.

3. The fluid-dispensing system of claim 1, further comprising: an external power supply that supplies electrical power to the master control dispenser.

4. The fluid-dispensing system of claim 1, wherein the master control dispenser has dimensions of approximately 9.5 inches wide by less than approximately 10 inches deep.

5. The fluid-dispensing system of claim 1, wherein the master control dispenser can detect when a satellite dispenser becomes operatively coupled to the master control dispenser.

6. The fluid-dispensing system of claim 5, wherein, when the master control dispenser detects that a satellite dispenser has become operatively coupled to the master control dispenser, the master control dispenser prompts a system user to enter identification information for the satellite dispenser that has become operatively coupled to the master control dispenser.

7. The fluid-dispensing system of claim 1, wherein the master control dispenser can detect when a satellite dispenser becomes operatively decoupled from the master control dispenser.

8. The fluid-dispensing system of claim 1, wherein the master control dispenser provides electrical power to at least one satellite dispenser.

9. The fluid-dispensing system of claim 1, wherein the master control dispenser stores at least one multi-step dispensing method.

10. The fluid-dispensing system of claim 9, wherein the master control dispenser displays an error message upon determining that a fluid container to be used in performing a selected dispensing method is not entered into the system.

11. The fluid-dispensing system of claim 1, wherein the master control dispenser can individually start or stop fluid dispensing by a plurality of satellites coupled to the master control dispenser.

12. The fluid-dispensing system of claim 1, wherein the master control dispenser can accept inputs from multiple grinder/polishers.

13. The fluid-dispensing system of claim 1, wherein the master control dispenser automatically advances a multi-step fluid-dispensing method from a currently executing step to a next step.

14. The fluid-dispensing system of claim 1, wherein the master control dispenser advances a multi-step fluid-dispensing method from a currently executing step to a next step based on a grinder/polisher-to-master control dispenser progress-to-next-step signal received by the master control dispenser from a grinder/polisher.

15. The fluid-dispensing system of claim 14, wherein the master control dispenser sends to at least one satellite a master control dispenser-to-satellite progress-to-next-step signal based on having received the grinder/polisher-to-master control dispenser progress-to-next-step signal.

16. The fluid-dispensing system of claim 1, wherein the master control dispenser activates or deactivates a fluid dispensing cycle based on a grinder/polisher-to-master control dispenser cycle-on/off signal received by the master control dispenser from a grinder/polisher.

17. The fluid-dispensing system of claim 16, wherein the master control dispenser sends to at least one satellite a master control dispenser-to-satellite cycle-on/off signal based on having received the grinder/polisher-to-master control dispenser cycle-on/off signal.

18. The fluid-dispensing system of claim 1, wherein the master control dispenser sends a cycle-start signal to a first satellite dispenser and to a second satellite dispenser thereby causing the first satellite to start a first fluid-dispensing cycle and causing the second satellite to start a second fluid-dispensing cycle, wherein the first fluid-dispensing cycle and the second fluid-dispensing cycle start at substantially the same time.

19. The fluid-dispensing system of claim 17, wherein a duration of the first fluid-dispensing cycle is different than a duration of the second fluid-dispensing cycle.

20. The fluid-dispensing system of claim 17, wherein a dispensing rate of the first fluid-dispensing cycle is different than a dispensing rate of the second fluid-dispensing cycle.

21. The fluid-dispensing system of claim 1, wherein the master control dispenser executes a default fluid-dispensing method, the execution of which is synchronized with execution by a grinder/polisher of a default grinder/polisher method that corresponds to the default fluid-dispensing method.

22. The fluid-dispensing system of claim 1, wherein the master control dispenser monitors a fluid level of at least one bottle of fluid and provides an indication when the monitored fluid level goes below a threshold.

23. A fluid-dispensing method performed by a master control dispenser, the method comprising:

using a master-control-dispenser processor, which is separate from a grinder polisher, to cause the master control dispenser to:

dispense fluid from at least one master-control-dispenser fluid containers, end fluid-dispensing control information to at least one satellite dispenser, and receive fluid-dispensing control information from the at least one satellite dispenser; and wherein the fluid-dispensing control information is selected from the group consisting of:

a cycle on/off signal, satellite dispenser identification information; and a progress-to-next-step signal for a multi-step fluid-dispensing method.

24. The fluid-dispensing method of claim 23, further comprising: receiving electrical power from a power supply that is external to the master control dispenser.

25. The fluid-dispensing method of claim 23, further comprising: detecting when a satellite dispenser becomes operatively coupled to the master control dispenser.

26. The fluid-dispensing method of claim 25, further comprising: upon detecting that a satellite dispenser has become operatively coupled to the master control dispenser, prompting a system user to enter identification information for the satellite dispenser that has become operatively coupled to the master control dispenser.

27. The fluid-dispensing method of claim 23, further comprising: detecting when a satellite dispenser becomes operatively decoupled from the master control dispenser.

28. The fluid-dispensing method of claim 23, further comprising: providing electrical power to at least one satellite dispenser.

29. The fluid-dispensing method of claim 23, further comprising: displaying an error message upon determining that a fluid container to be used in performing a selected dispensing method is not programmed into the system.

30. The fluid-dispensing method of claim 23, further comprising: individually starting fluid dispensing by a plurality of satellites coupled to the master control dispenser.

31. The fluid-dispensing method of claim 23, further comprising: individually stopping fluid dispensing by a plurality of satellites coupled to the master control dispenser.

32. The fluid-dispensing method of claim 23, further comprising: automatically advancing a multi-step fluid-dispensing method from a currently executing step to a next step.

33. The fluid-dispensing method of claim 23, further comprising: advancing a multi-step fluid-dispensing method from a currently executing step to a next step based on a grinder/polisher-to-master control dispenser progress-to-next-step signal received by the master control dispenser from a grinder/polisher.

34. The fluid-dispensing method of claim 23, further comprising: sending to at least one satellite a master control dispenser-to-satellite progress-to-next-step signal based on having received the grinder/polisher-to-master control dispenser progress-to-next-step signal.

35. The fluid-dispensing method of claim 23, further comprising: activating or deactivating a fluid dispensing cycle based on a grinder/polisher-to-master control dispenser cycle-on/off signal received by the master control dispenser from a grinder/polisher.

36. The fluid-dispensing method of claim 23, further comprising sending to at least one satellite a master control dispenser-to-satellite cycle-on/off signal based on having received the grinder/polisher-to-master control dispenser cycle-on/off signal.

37. The fluid-dispensing method of claim 23, further comprising: sending a cycle-start signal to a first satellite dispenser and to a second satellite dispenser thereby causing the first satellite to start a first fluid-dispensing cycle and causing the second satellite to start a second fluid-dispensing cycle, wherein the first fluid-dispensing cycle and the second fluid-dispensing cycle start at substantially the same time.

38. The fluid-dispensing method of claim 23, wherein a duration of the first fluid-dispensing cycle is different than a duration of the second fluid-dispensing cycle.

39. The fluid-dispensing method of claim 23, wherein a dispensing rate of the first fluid-dispensing cycle is different than a dispensing rate of the second fluid-dispensing cycle.

40. The fluid-dispensing method of claim 23, further comprising: executing a default fluid-dispensing method, the execution of which is synchronized with execution by a grinder/polisher of a default grinder/polisher method that corresponds to the default fluid-dispensing method.

41. The fluid-dispensing method of claim 23, further comprising: monitoring a fluid level of at least one bottle of fluid and indicating when the monitored fluid level goes below a threshold.

* * * * *